United States Patent [19]

Bisutti

[11] 4,074,500

[45] Feb. 21, 1978

[54] CONCRETE PILE COUPLING DEVICE

[76] Inventor: Guy Bisutti, 951 Montee de l'Eglise, Ile Bizard, Quebec, Canada

[21] Appl. No.: 667,349

[22] Filed: Mar. 16, 1976

[51] Int. Cl.[2] ..... E04C 3/30

[52] U.S. Cl. ..... 52/726; 52/728; 52/301

[58] Field of Search ..... 52/726, 728, 423, 724, 52/725, 301; 61/53, 56; 403/335, 337

[56] References Cited

U.S. PATENT DOCUMENTS

| | | | |
|---|---|---|---|
| 3,884,589 | 5/1975 | Liedholm | 61/56 |
| 3,901,042 | 8/1975 | Wahman | 61/56 |

FOREIGN PATENT DOCUMENTS

| | | | |
|---|---|---|---|
| 2,116,538 | 2/1973 | Germany | 52/726 |
| 673,081 | 10/1964 | Italy | 52/726 |

*Primary Examiner*—Wayne L. Shedd

*Attorney, Agent, or Firm*—Robert L. Slater, Jr.

[57] ABSTRACT

A high strength concrete pile coupling device utilizing two identical members, having machined precision surfaces, the machined surfaces juxtaposed to assure precision axial alignment of the coupled piles, the joint members mounted to the concrete piles with metal structures to transmit into and widely disburse compression torsion and bending forces deep within the concrete pile to avoid excessively high stress zones within the co-joined concrete piles.

3 Claims, 8 Drawing Figures

CONCRETE PILE COUPLING DEVICE

FIELD OF THE INVENTION

The present invention relates to a coupling device for interlocking the adjacent ends of concrete piles. More particularly, the invention pertains to a high strength pile joint device for joining concrete piles end to end to form an extended continuous high strength pile.

BACKGROUND OF THE INVENTION

In the construction of foundations, an extended length continuous concrete pile may be formed by joining two or more pile units end to end. The requirement for piles of extended length is increasing. As structures are built taller and with greater concentration of weight, the foundation to remain stable through the life of the building must be deeper, often deep enough to rest on bedrock below several hundred feet of overburden. Foundations having 400 feet deep or more pile bases are not now uncommon.

When concrete piles are joined end to end, the joint must have a cross section no larger in any dimension than the non-jointed section of the piling. The joints must also be as strong as the non-jointed piling in order to remain straight so that the jointed pile will drive vertically true during the high stress pile driving process.

A variety of concrete pile joining devices have been disclosed in the past; all of these earlier devices have exhibited one or more serious limitations when put into practical usage. Most of these earlier devices required a male and a female element along with various fasteners to form a joint. The need for two kinds of joining elements increases the inventory requirements, and is an added complication in field assembly of jointed piles. While some of these earlier joining devices utilized two identical members to complete the joint, all of the earlier joining devices of diverse or identical elements lacked resistance to bending or torsion loads even though all appeared to have good compression load resistance. None of these earlier devices exhibited strength in all modes of loading and also exhibited convenience of assembly in the field.

When a concrete pile of extended length formed by axially coupling a number of sections is driven into place, even minute differences in axial alignment in the joints will result in large deflection of the pile at its leading end. In other words, for long jointed piles, the coupling joints must align the joined piles with precision. The earlier disclosed pile joints all permit considerable tolerance in the joint alignment. For piles having only two or three joined sections, these conventional alignment tolerances are not critical. However, in a jointed pile of six or 10 joined sections, a closely held precision of alignment is critical to constructing a dependable foundation structure.

Another serious limitation on all the earlier disclosed pile joint device resides in the manner in which, in these respective earlier devices, the joint element is mounted to and receives the load forces from the concrete portion of the pile and from the metal reinforcing structures imbedded within the concrete. In these earlier devices, the end joint elements attached respectively to the extreme ends of the concrete piles often resulted in excessively high stresses within the concrete sections adjacent to the joining element. While the joint in these earlier devices may survive application of large loads, the concrete pile often fractured in the high stress zone. Notwithstanding, the long practice in foundation construction of joining pile sections to form an extended length pile, there remains a need for a high strength, precision aligned, easily assembled, low cost simple pile coupling device.

OBJECTS OF THE INVENTION

Accordingly, one object of the present invention is to provide a concrete pile joint having high resistance to compression, bending and torsion loads.

Another object of the present invention is to provide a pile joint device which mounts onto the end of a concrete pile in a manner to distribute the load from the joint device through the concrete and into the metal reinforcing structure imbedded within the concrete without concentrating loads and exceeding safe stress limits within the concrete sections adjacent to the joining device.

Still another object of the present invention is to provide a pile joint device which assures precision axial alignment of juxtaposed coupled concrete pile sections.

Yet another object of the present invention is to provide a high strength concrete pile joining device comprised of two identical members, each member respectively being mounted to one end of two axially juxtaposed concrete piles, the two identical members being easily assembled together at a construction site to form the joint.

Still another object of the present invention is to provide a concrete pile joining device requiring only one joint member, readily coupled to an identical member, which device may be manufactured at a relatively low cost.

These and other objects and advantages of my invention will be evident from the following drawings, specifications and claims.

DESCRIPTION OF THE INVENTION

Figure 1:
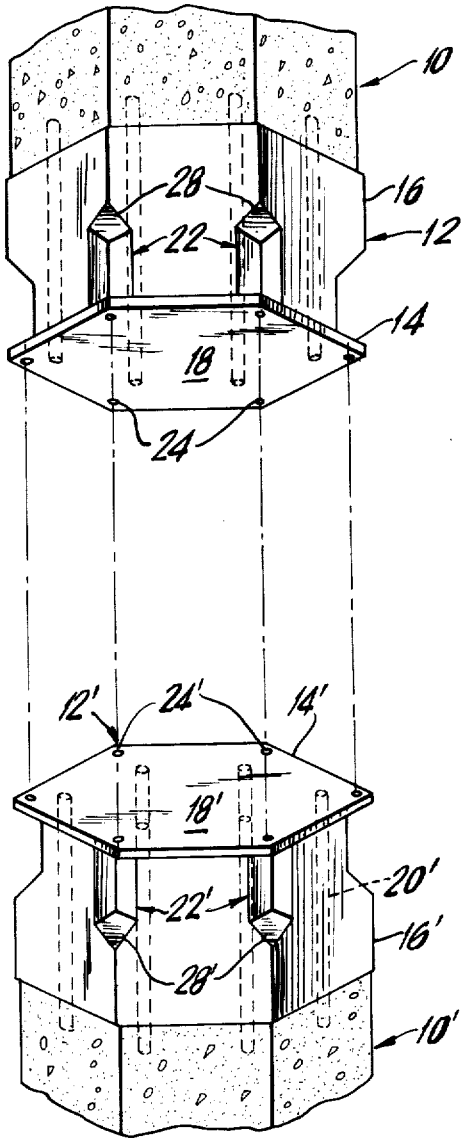
FIG. 1 is an exploded perspective view of two adjacent ends of concrete piles, each equipped with a first embodiment of a pile joint device made in accordance with the present invention.

Referring more particularly to FIG. 1, the ends 10, 10' of two concrete piles are shown in adjacent position just prior to be joined together. Each end 10, 10' is capped with a coupling device 12, 12' which consists principally of two portions: a transverse base portion or plate member 14, 14' and a sleeve portion 16, 16' in the form of a skirt receiving the end of the concrete pile.

The transverse base portion 14, 14' has a flat planar outer face 18, 18'. To the opposite face of the base portion, a series of elongated studs (shown in dotted lines as 20') are fixedly secured, such as by welding, and extend in the longitudinal axis of the concrete pile. These studs are provided to tightly anchor the coupling devices 12, 12' to their respective concrete piles 10, 10'.

The sleeve portion 16, 16' extends perpendicularly at the periphery of the transverse base portion 14, 14'. The sleeve portion maybe welded to the base portion or both portions may be integral and define one unitary member.

A series of peripherally spaced recesses 22, 22' are provided in the sides of the sleeve 16, 16'. These recesses extend lengthwise and open onto the transverse base 14, 14'. A series of holes 24, 24' are provided in the areas adjacent the recesses 22, 22'.

An important advantage of the present invention is that the same coupling device may be used at both ends of a concrete pile; this avoids the need for having a male member and a female member at each end of a concrete pile. The coupling device of the present invention is always joined to an identically constructed coupling device of another concrete pile with which it is to be joined.

In the construction of foundations, it is important that the pile coupling devices do not alter the cross section dimensions of the concrete pile.

The recesses 22, 22' serve to receive anchoring means, such as bolts 26 (see FIG. 2), which extend through matching openings 24, 24' and are received in the corresponding recesses of the abutting coupling device. The recesses 22, 22' may have various shapes, rounded or angled. To assist in the positioning the bolts in the recesses, the recesses are provided with inclined faces 28, 28' in the embodiment illustrated.

Figure 2:
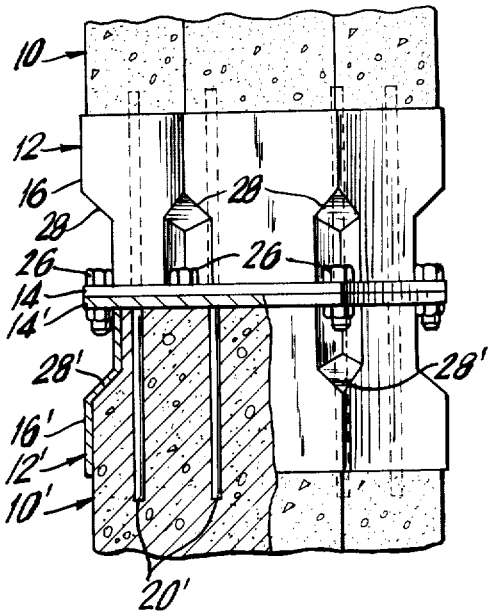
FIG. 2 is a fragment of an elevation view partly cutaway illustrating further the embodiment of my invention shown in FIG. 1, wherein two adjacent pile ends are shown joined together.

The coupling device may have various cross section shapes such as will coincide with the cross section of any of the variety of concrete pile shapes. In addition to polygonal as illustrated in FIGS. 1 and 2, round, square and other shapes are frequently used.

Although not shown in the drawings, the coupling device may be provided with a centrally disposed opening for allowing passage, between hollow concrete piles, of conduits therethrough.

Figure 3:
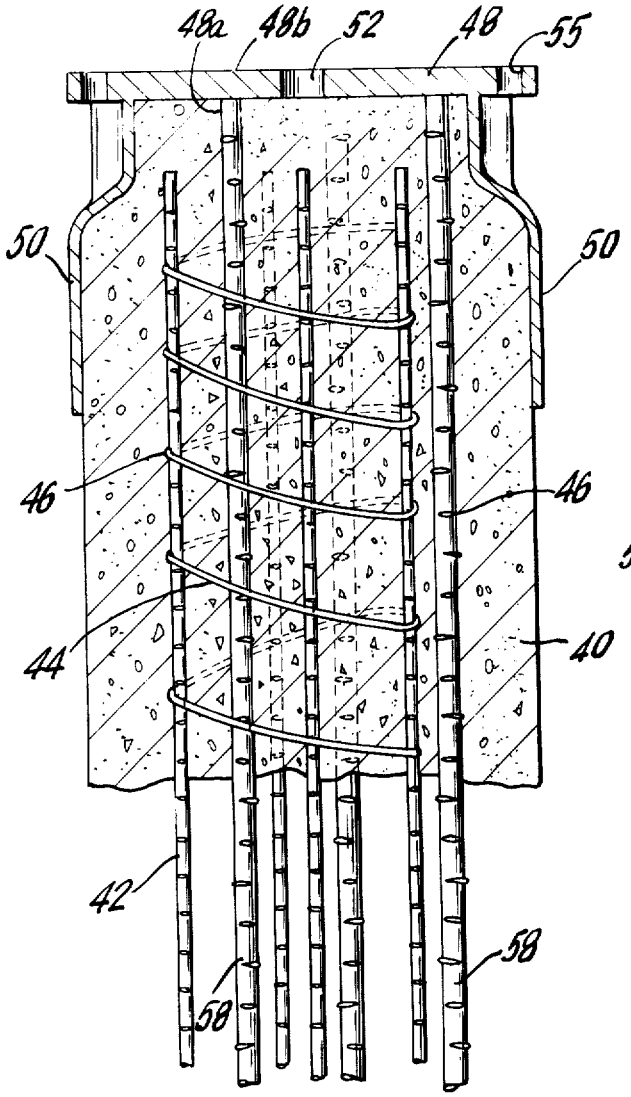
FIG. 3 illustrates a second embodiment of my invention slightly altered from the first embodiment shown in a cross section view illustrating the manner in which my novel pile joint is mounted to one end of a reinforced concrete pile.
Figure 4:
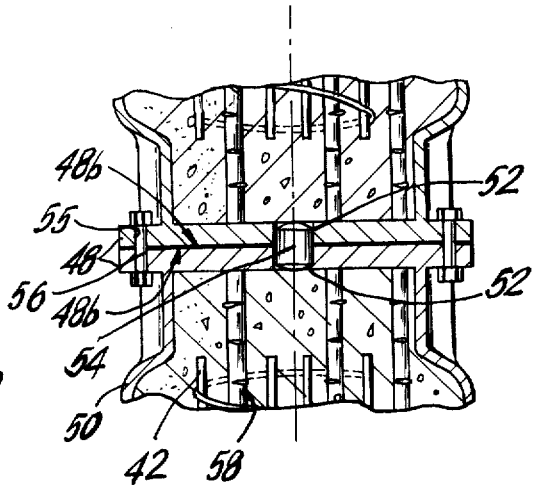
FIG. 4 is a cross section view of a fragment of the embodiment of my invention shown in FIG. 3 illustrating two piles joined together in accordance with the principals of my invention.

Referring now to a slightly altered second embodiment of my invention which is illustrated in FIGS. 3 and 4, a reinforced concrete pile 40, having metal reinforcing rods 42, a metal wire spiral 44 welded to the rods at numerous interstices 46 is imbedded within the concrete pile.

My novel high strength pile joint device comprises a face plate or flange 48 having planar shape and dimensions congruent with the cross section shape and dimensions of the concrete pile 40. Attached to the face plate 48, as a right circular cylinder in the embodiment illustrated is a sleeve 50. The sleeve fits over the end of the concrete pile and also has the shape and dimensions of the pile cross section. While the drawings illustrate a cylindrical cross section concrete pile, other geometric shapes commonly used for concrete piles are also within the scope of my invention. For instance, square, hexagonal or interlocking shapes; in fact any polygonal or curved contour as may be convenient for a particular foundation or sunken retaining walls is accommodated by readily constructed embodiments of my invention.

The face plate 48 is provided with a small central aperture 52. A centering stud 54, illustrated in FIG 4, is utilized to conveniently center align and position two piles in the field assembly process.

A plurality of rods 58 are fixedly mounted to the interior side 48*a* of the face plate 48. The rods 58 are shown as welded to the face plate interior surface 48*a*. However, other means of securely fastening the rods to the plate are also within the scope of my invention. The rods 58 extend through and beyond the sleeve 50 as is illustrated in FIG. 3 and penetrate well within the metal reinforcing structure of wire spiral 44 and reinforcing rods 42.

Load forces from the face plate 48 are transmitted through rods 58 to deep within the concrete pile and to within the metal reinforcing structures imbedded within the concrete. The concrete 40 exhibits high compression load resistance, but comparatively small torsion and bending load resistance. On the other hand, the metal reinforcing structure comprised of reinforcing rods 42 welded to a heavy wire spiral 44 bears torsion and bending loads comparatively well. In the arrangement illustrated in FIG. 3, the coupling device rods 58 transmit the load forces—compression, torsion and bending to the concrete and to the metal reinforcing members 42, 44 and 46. By this arrangement, a pile joint of strength greater than the non-jointed concrete pile is created. Moreover, the load forces from the end joint are transmitted and disbursed through an extended section of the concrete pile and not concentrated in a small section thereof. The joint member forces are transmitted into the concrete pile through the rods 58. Compressive loads are well absorbed by the concrete. Bending and torsion loads are transmitted to the steel reinforcing structures 42 and 44 but through a plurality of short connections in various planes through the concrete. Thus, no high stress regions are created within the concrete pile structure.

The flange or face plate 48 is provided with a machined true surface 48*b* which interfaces with an identical machined true planar surface when coupled to an adjoining pile. FIG. 4 illustrates the juxtaposing, in my invention, of two machined surfaces to form a precision aligned joint. Thus, my invention provides a convenient means to assure any number of concrete pile sections may be axially aligned in field assembly with close precision. The assembly is coupled by tightening bolts 56 which pass through bolt holes 55 provided within the flanged end plate 48. The precise axially aligned rigid coupling of pile sections is a matter of importance in construction of deep foundations.

Pile foundations are subject to severe compression, bending and torsion forces both during the pile driving operation and subsequently during the life of the building mounted above due to earth tremors, earth settling and erosion from water flowing through and about the foundation piles. Therefore, the strength of the pile joints in bending and torsion is equally as important as in compression in construction of stable long life structures.

Test data illustrative of the load resistance to compression, bending and torsion of my novel invention is presented below.

Compression tests of standard 6-inch diameter cylinders of concrete, five with and five without a joint utilizing my invention were tested. Average results in pounds per square inch before fracture were:

without joint — 6810 psi with joint — 7160 psi

From the above data, it is evident that the jointed pile test section was stronger than the non-jointed concrete pile.

Torsion load resistance of the concrete pile and of the joint may be calculated with well-known conventional formulas described in the literature. The axial torsion strength of a commonly used reinforced concrete pile is 135,000 pound inches. The axial torsion strength of a joint for the same size is 269,000 pound inches.

The deflection of a loaded beam is characterized by the elastic curve equation which in rectangular coordinates may be written $$M = E\,I\,(d^2y/dx^2)$$

where $M$ = moment or the load in pounds times distance, $E$ = the modulus of elasticity for the material, $I$ = the moment of inertia of the beam about the neutral plane, $y$ equals the (vertical) deflection and $x$ = the distance (horizontal) along the beam. The coordinates for $x$ and $y$ are normally selected to simplify the double integration process to most easily solve the equation for the deflection $y$. The elastic curve equation for bending, described above, is fully discussed in numberous places in the literature.

Figure 5:
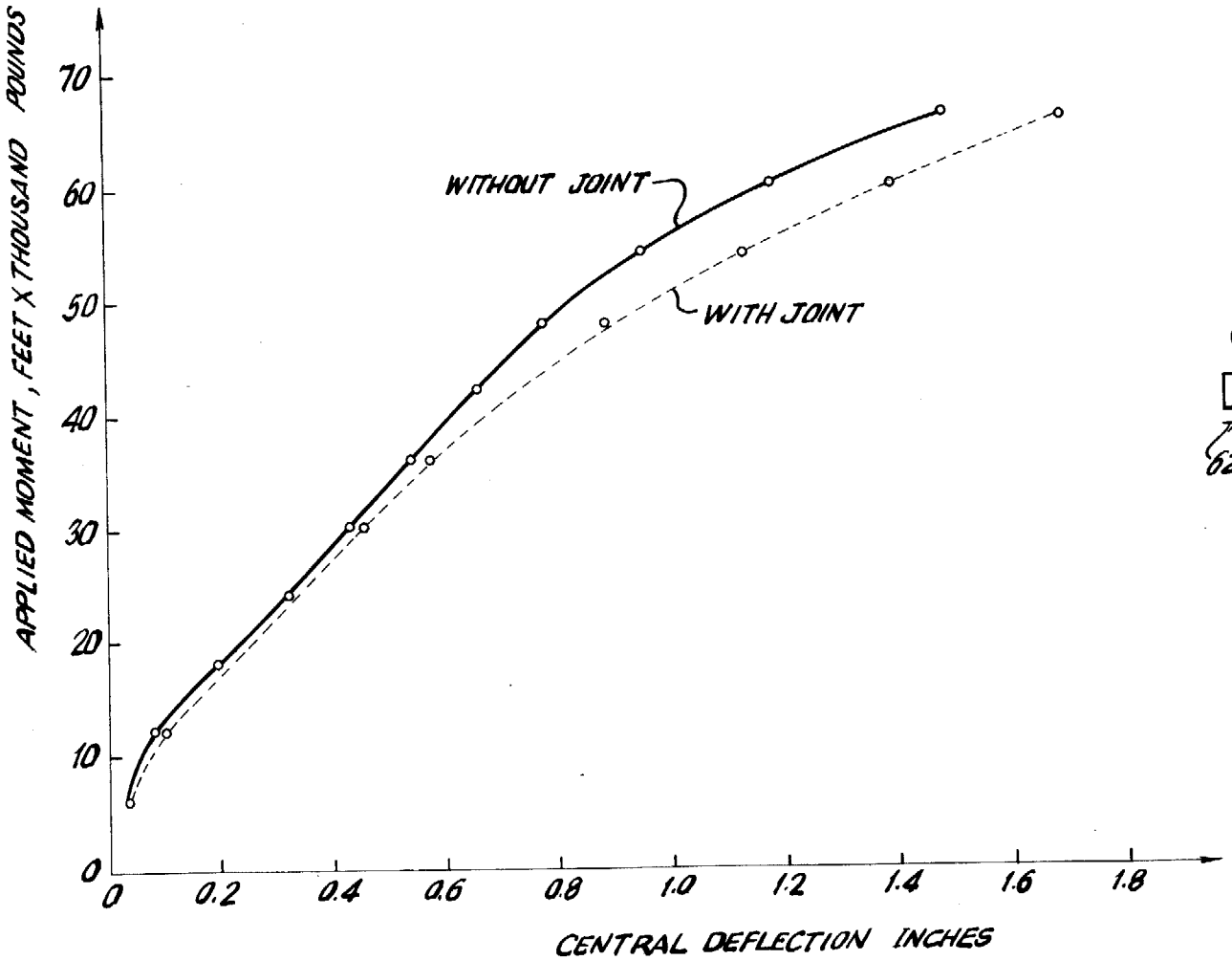
FIG. 5 is a graph illustrating the comparative response in terms of the central deflection versus load expressed as applied moment of a pile mounted as a beam without a joint (solid line) and of a jointed pile mounted as a beam (broken line) in which one of my novel pile joints has been installed.
Figure 7:
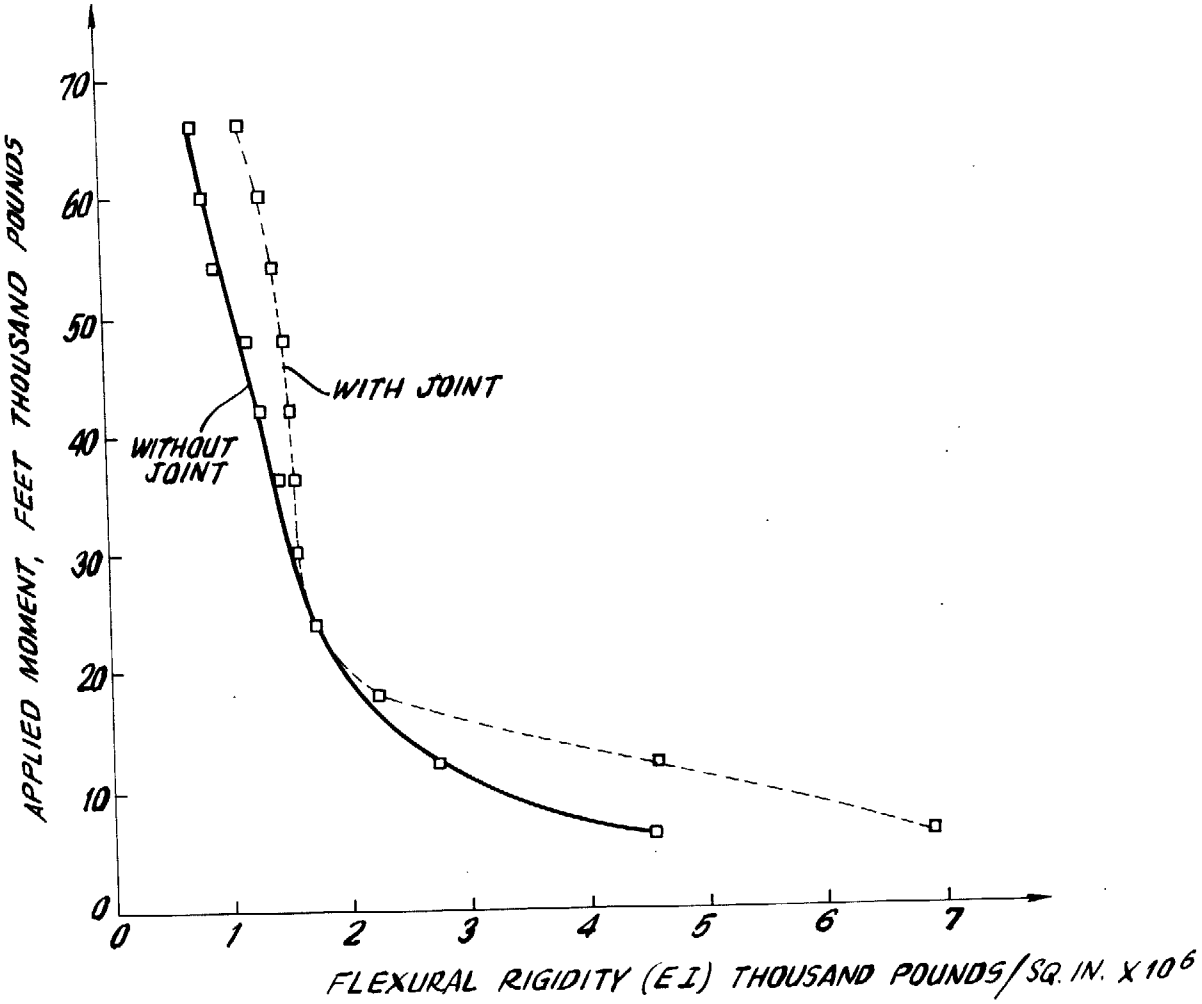
FIG. 7 is a graph illustrating comparative response in terms of flexural rigidity versus load expresses as applied moment of a concrete pile mounted as a beam without a joint (solid line) and of a jointed pile mounted as a beam (broken line) in which one of my novel pile joints has been installed.

While the elastic curve equation is extremely useful in estimating the bending characteristics of a beam, it is necessary to test the bending deflection in a beam composed of component parts to ascertain the elastic bending characteristics. The graphs shown in FIGS. 5 and 7 are derived from such test data. The solid lines in each graph are from non-jointed pile sections and the broken lines are from data derived from jointed piles.

Figure 6:
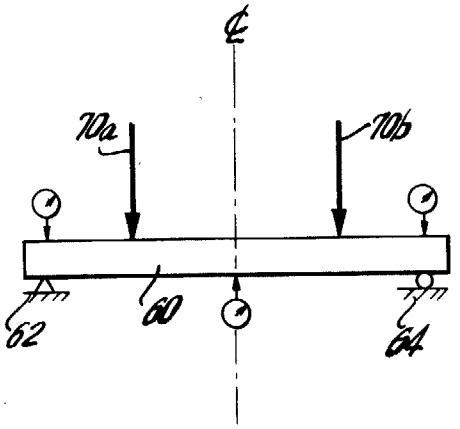
FIG. 6 is a schematic diagram illustrating the distribution of loads and support for a non-jointed pile (solid line in the graphs) utilized in gathering the beam deflection data shown in the graph of FIG. 5 and the flexural rigidity data shown in the graph in FIG. 7.

FIG. 6 illustrates schematically the test arrangement with a non-jointed pile utilized to obtain the test data (solid lines) shown in FIGS. 5 and 7. A non-jointed concrete pile 60 is freely supported at either end by supports 62 and 64. A deflection gauge 66 is at the center of the beam between the supports 62 and 64. Two equal loads 70*a*, 70*b* are applied to the pile at the points, respectively, midway between the center line and the supports 62, 64. The test arrangement is readily visualized by referring to FIG. 6.

Figure 8:
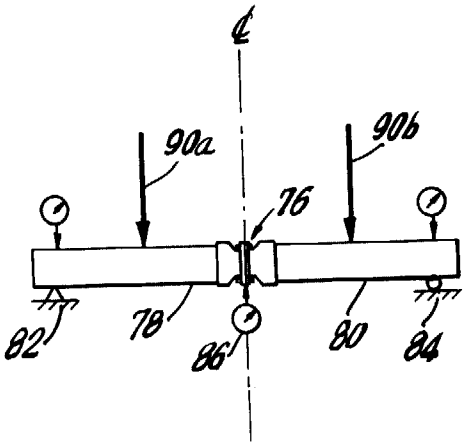
FIG. 8 is a schematic diagram illustrating the distribution of loads and supports for a pile mounted as a beam on which one of my novel pile joint devices has been installed and utilized in gathering the data shown in the graphs of FIGS. 5 and 7.

FIG. 8 illustrates schematically the test arrangement for a jointed pile from which data shown in the curves (broken lines) in FIGS. 5 and 7, was obtained. A concrete pile joint 76 made in accordance with my subject invention joins two concrete pile sections, 78 and 80 into one. The jointed pile is then freely mounted on two supports, 82 and 84 at either end of the pile. A deflection gauge 86 is mounted onto the jointed beam at the center line midway between the supports, 82 and 84. Two equal loads 90*a* and 90*b* are applied to the beam at points midway respectively between the supports 82 and 84 and the center line of the beam between the supports. The foregoing test arrangement is readily visualized by reference to the illustration in FIG. 8.

Referring now to FIG. 5 a graph showing central deflection in inches on the abscissa and applied moment expressed in feet times thousand pounds on the ordinate illustrates the comparative deflection, $y$, of a non-jointed (solid line) and a jointed (broken line) pile. The test arrangements may be visualized by referring to FIGS. 6 and 8 which are described above.

From the test data shown in the curves, it is to be observed the jointed pile successfully resisted bending moment forces within the elastic limit equal to those bending forces resisted by the non-jointed pile. However, the jointed pile structure deflected approximately 15% more at the extreme applied loads than the concrete non-jointed pile. There was no loss of bending load resistance in a jointed pile using my invention compared to the bending load resistance of a non-jointed similarly dimensioned concrete pile. Greater elasticity, exhibited through the larger deflection for equal loads, is to be observed for jointed piles using my invention as compared to similar size non-jointed concrete piles.

FIG. 7 illustrates the flexural rigidity (abscissa) of the test specimens in response to applied moment (ordinate). The flexural rigidity is calculated from the deflection data using the above described elastic curve equation. Flexural rigidity = E I and has the units thousands of pounds per square inch times the factor of 106, or one million. Applied moment is expressed in feet time thousands of pounds.

Both curves, jointed (broken line) and non-jointed (solid line) specimens follow the same general response curve. The greater elasticity of the jointed specimen is readily observed at the lower applied moment where the flexural rigidity of the steel joint is larger than that of the concrete specimen without a joint. From the data illustrated by the two curves in FIG. 7, it is readily observed that the jointed pile section, compared to a non-jointed concrete pile, has in fact, a larger or no less than equal flexural rigidity or elastic load resistance capacity at all values of applied moment.

From the data presented, it is readily observed that jointed piles using my invention are equal or greater in load resistance to applied compression, torsion and bending loads compared to the load resistance of a similarly sized reinforced concrete pile subjected to comparable loading.

The foregoing specification and description is illustrative of my invention, the scope of which is defined in the following claims.

What is claimed is:

1. A high strength pile coupling device for attaching concrete piles end to end, the device comprised of two identical joint members demountably attachable one to the other, each member being fixedly attached to the ends, respectively, of two axially juxtaposed piles, a joint member comprising a hollow cylindrical sleeve having a first end and a second end, the cylindrical sleeve at the first end thereof securely mounted at right angles to a flanged end plate, the flanged end plate having a true planar surface on the side opposite the sleeve, the flanged end plate perimeter being coextensive with the radial cross section of the piling, the sleeve being open at the second end thereof, means securely mounted within the sleeve to the end plate and extending through the open end of the sleeve, the means when mounted to a pile end being imbedded within and bonded to the internal structures within the concrete pile, a plurality of holes in the end plate positioned about the perimeter thereof in spaced relationship one to another, the sleeve having indented recesses to clear the end plate holes leaving the holes in the end plate exterior to the sleeve, fastener means sized to pass through the end plate holes, whereby when the true planar surfaces of two flanged end plates are axially aligned and juxtaposed, and the fastener means mounted through the flanged end plate holes of each member, a high strength axially aligned coupling of the concrete piles is formed.

2. A coupling device for fixing at one end of a concrete pile with a view to joining end to end said concrete pile to a second concrete pile equipped with an identically constructed coupling device, comprising; a transverse base portion and a sleeve disposed peripherally of said base portion and extending outwardly therefrom; said sleeve including a series of peripherally spaced lengthwise recesses opening to said base portion; said base portion including a corresponding series of holes in the area adjacent said recesses whereby securing bolts received in the recesses of one coupling device may extend through the base portions of abutting coupling devices of adjacent concrete piles and be received in the corresponding recesses of other coupling device.

3. A coupling device as defined in claim 2, wherein said base portion includes a flat planar outer face and an inner face; stud means being fixed at one end thereof to said inner face and extending in the direction of the longitudinal axis of said pile.

* * * * *